US010900735B2

(12) United States Patent
Wirth

(10) Patent No.: US 10,900,735 B2
(45) **Date of Patent: *Jan. 26, 2021**

(54) GUN, ESPECIALLY AIR GUN OR FIREARM

(71) Applicant: BERETTA HOLDING S.P.A., Gardone (IT)

(72) Inventor: André Wirth, Haguenau (FR)

(73) Assignee: BERETTA HOLDING S.P.A., Gardone V.T. (IT)

( * ) Notice: Subject to any disclaimer, the term of this patent is extended or adjusted under 35 U.S.C. 154(b) by 0 days.

This patent is subject to a terminal disclaimer.

(21) Appl. No.: 16/717,182

(22) Filed: Dec. 17, 2019

(65) Prior Publication Data

US 2020/0124372 A1 Apr. 23, 2020

Related U.S. Application Data

(63) Continuation of application No. 15/528,460, filed as application No. PCT/EP2015/077132 on Nov. 19, 2015, now Pat. No. 10,514,224.

(30) Foreign Application Priority Data

Nov. 21, 2014 (EP) ..... 14003919

(51) Int. Cl.
*F41A 21/30* (2006.01)

(52) U.S. Cl.
CPC ..... *F41A 21/30* (2013.01)

(58) Field of Classification Search
CPC ..... F41A 21/30; F41A 21/32; F41A 21/44; F41A 21/325; F41A 21/36; F41A 21/34
See application file for complete search history.

(56) References Cited

U.S. PATENT DOCUMENTS

| | | | |
|---|---|---|---|
| 1,111,202 | A | 9/1914 | Westfall |
| 1,406,404 | A | 2/1922 | Mccrudden |
| 3,776,093 | A | 12/1973 | Leverance |
| 4,907,488 | A | 3/1990 | Seberger |
| 5,355,765 | A | 10/1994 | Rogers |
| 5,753,846 | A | 5/1998 | Koon |
| 7,353,741 | B2 | 4/2008 | Brixius |
| 8,261,651 | B2 | 9/2012 | Casas Salva et al. |
| 9,103,618 | B2 | 8/2015 | Daniel et al. |
| 9,506,712 | B2 | 11/2016 | Mather |
| 9,658,018 | B1 | 5/2017 | Heckert et al. |

(Continued)

FOREIGN PATENT DOCUMENTS

| | | | |
|---|---|---|---|
| CA | 2913248 A1 * | 5/2017 | ..... F41A 21/34 |
| CA | 2913248 A1 | 5/2017 | |

(Continued)

*Primary Examiner* — Benjamin P Lee

(74) *Attorney, Agent, or Firm* — Rimon, P.C.

(57) ABSTRACT

The invention relates to a gun, especially an air gun or firearm, comprising a barrel arrangement (1) that has at least one barrel element (2) forming at least part of a barrel of the gun, and a silencer element (3) that is or can be fastened to the barrel element (2); in order for the silencer element (3) to be fastened to the barrel element (2), at least one clamping element (12) that can be or is fastened within the silencer element (3) is used to be able to axially clamp or axially clamp the silencer element (3) against at least one contact element (5) located or formed on the barrel element (2).

19 Claims, 3 Drawing Sheets

(56) References Cited

U.S. PATENT DOCUMENTS

Figure 1:
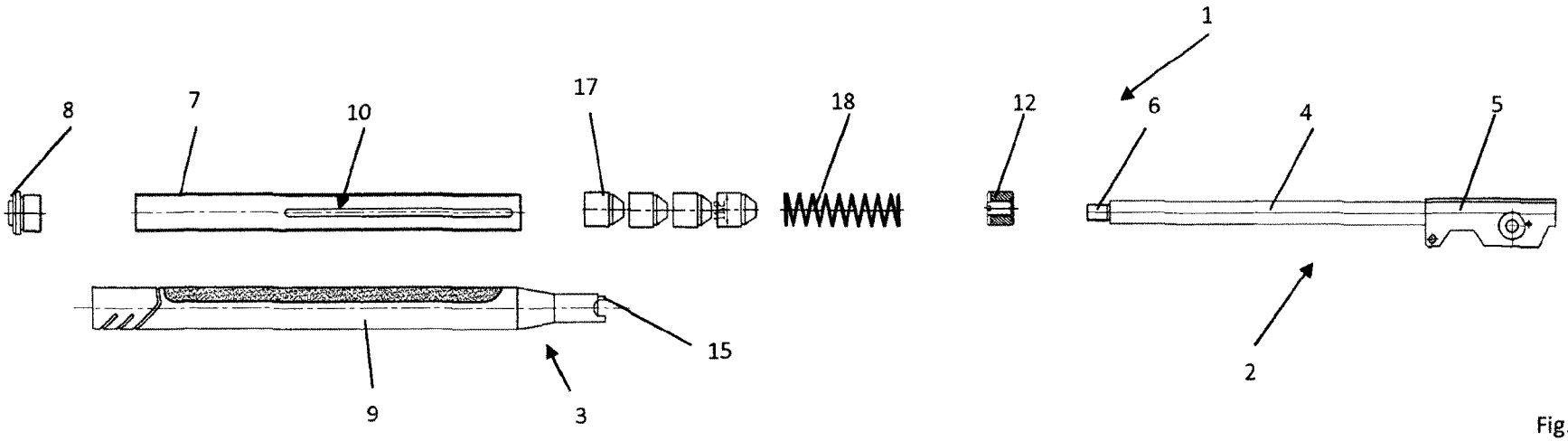

| | | | |
|---|---|---|---|
| 2014/0190345 | A1 | 7/2014 | Daniel et al. |
| 2016/0003570 | A1 | 1/2016 | Tonkin |
| 2017/0191780 | A1 | 7/2017 | Barrett et al. |

FOREIGN PATENT DOCUMENTS

| | | | |
|---|---|---|---|
| DE | 164766 | A | 9/1904 |
| FR | 1529598 | A | 6/1968 |
| WO | 2009139803 | A2 | 11/2009 |

* cited by examiner

GUN, ESPECIALLY AIR GUN OR FIREARM

This application is a Continuation application of U.S. patent application Ser. No. 15/528,460, filed May 19, 2017, now allowed, which was a United States national stage entry of an International Application serial no. PCT/EP2015/077132 filed Nov. 19, 2015 which claimed priority to European Patent Application serial no. 14003919.9 filed Nov. 21, 2014. The contents of these applications are incorporated herein by reference in their entirety.

The invention concerns a gun, especially an air gun or firearm, comprising a barrel arrangement with a barrel element forming at least part of a barrel of the gun and a silencer element that is or can be fastened to the barrel element.

Guns, i.e. especially air guns or firearms, with silencer elements for reducing firing-induced sound emissions are known in different embodiments. In particular, embodiments are known whereby suitable silencer elements are fastened directly onto the free end of the barrel or in front of the barrel of a corresponding gun. The silencer elements are usually attached to the barrel first, for example by means of a push fit, and subsequently fastened to the barrel by means of suitable attachment elements, such as for example threaded bolts or threaded pins.

With such an embodiment, the possibility of manipulating or dismantling the silencer element or the gun is provided both by the location of the fastening of the silencer element onto the barrel and by the type of fastening of the silencer element onto the barrel. This constitutes an improved situation, for example for safety reasons.

The object of the invention is to specify an improved gun.

The object is achieved by a gun according to claim 1 and by a method for manufacturing a gun according to claim 15. Claims 2 through 14 concern advantageous embodiments of the gun.

The gun according to the invention can be an air gun, such as for example an air rifle or an air pistol, or a firearm, especially a small-caliber firearm such as a different rifle or a different pistol. In principle, all types of suitable air guns or firearms come into consideration. The principle according to the invention that is described in detail below is therefore not limited to a certain type of gun.

The gun according to the invention comprises, in addition to a base body, which for example comprises a firing mechanism (trigger), a handling section, such as a handle section, a shaft section or shoulder contact section, a projectile element storage means (magazine), etc., a barrel arrangement, which is implemented as at least one barrel element forming at least part of the barrel of the gun and a silencer element that is or can be fastened to said barrel element for reducing firing-induced sound emissions. The silencer element and the barrel element are in principle to be considered as separate components or groups of components. If the gun comprises a break barrel, the barrel element can form the break barrel or part of the break barrel of the gun.

A significant aspect of the invention is the fastening of the silencer element onto the barrel element. The fastening of the silencer element onto the barrel element is carried out by pushing the silencer element onto the barrel element and axially clamping the silencer element against at least one contact element disposed or formed on the barrel element. The contact element on the barrel element side can be implemented in one piece with the barrel element. It is also conceivable that a contact element on the barrel element side is a separate component from the barrel element, which however is captively fastened to the barrel element in a shape-locking and/or force-locking and/or bonded manner. Specifically, a contact element on the barrel element side can be fastened to the barrel element by means of a press fit for example.

Owing to the axial clamping of the silencer element against the barrel element, the silencer element is in principle disposed captively and irreversibly, i.e. typically also secured in location and position. Depending on a respective clamping force, a rotationally secure attachment of the silencer element to or relative to the barrel element may also result from the axial clamping of the silencer element against the contact element on the barrel element side. The rotationally secure fastening of the silencer element onto or relative to the barrel element can in any case be achieved by the design measures described below in detail.

The axial clamping of the silencer element against the contact element on the barrel element side is implemented by means of at least one clamping element. Therefore, by means of the clamping element an axial force (clamping force) can be exerted on the silencer element, by means of which the silencer element is axially clamped against the contact element on the barrel element side. In this case, the silencer element can be clamped against the contact element on the barrel element side over the entire axial length thereof or only over part of the axial length thereof. The clamping of the silencer element against a suitable contact element on the barrel element side, and thereby the fastening of the silencer element onto the barrel element, is carried out by fastening the clamping element onto the barrel element. By releasing the fastening of the clamping element from the fastening region on the barrel element side, releasing the clamping of the silencer element against a suitable contact element on the barrel element side is also possible. If no additional principle of fastenings for the fastening of the silencer element onto the barrel element are provided, the fastening of the silencer element onto the barrel element is therefore reversible (without damage or destruction).

The at least one clamping element is disposed within the silencer element. The clamping element is disposed within a typically hollow cylindrical section of the silencer element, so that it is not externally accessible or is only externally accessible with difficulty. Equally, the clamping element is not externally visible, so that the principle of fastening of the silencer element onto the barrel element cannot be determined from the outside without suitable knowledge. In other words, the fastening of the silencer element onto the barrel element is an "internal fastening". Manipulation or dismantling of the silencer element is not possible or is only possible with difficulty, at least without special tools.

From the principle of the fastening of the silencer element onto the barrel element according to the invention, wherein the silencer element and the barrel element, as mentioned, are in principle to be considered as separate and separately manufactured components or groups of components, it also results that the silencer element can be simply individually adapted to a suitable gun in the dimensioning thereof, as in the choice of materials thereof, in terms of production technology and thereby in a cost-effective manner. If the gun is a relatively "heavy" air rifle for example, the dimensioning and choice of materials of the silencer element can be designed accordingly. Furthermore, for a barrel element made of metal there is the advantage that said barrel element—as a separate component or group of components—is corrosion-resistant independently of the silencer element, i.e. the barrel element can be implemented with a corrosion-resistant surface or a corrosion-resistant coating on the surface, for example implemented by oxidizing, or for example as an injection-molded part. In this way, the service life of the barrel element can be increased in a simple manner in terms of production technology and thereby in a cost-effective manner.

The described arrangement or fastening of the clamping element can for example be implemented by fastening or enabling the fastening of the clamping element onto a fastening region on the barrel element side protruding into a hollow cylindrical section of the silencer element, wherein the clamping element can be or is clamped axially against at least one contact element on the silencer element side, such that the silencer element is clamped against the contact element on the barrel element side. The "internal fastening" of the clamping element can be carried out by means of a fastening region on the barrel element side that protrudes into a hollow cylindrical section of the silencer element. The clamping element comprises a mating fastening region corresponding to the fastening region on the barrel element side. The fastening of the clamping element onto the fastening region on the barrel element side thus causes axial clamping of the clamping element against a contact element on the silencer element side; the clamping element is therefore clamped against a contact element on the silencer element side by the fastening onto the barrel element. This results in the described axial clamping of the silencer element against the contact element on the barrel element side. The fastening region on the barrel element side is typically formed in the region of a free end of the barrel element on the opening side.

The clamping element can be or is attached to the fastening region on the barrel element side in a shape-locking and/or force-locking and/or bonded manner.

The force-locking attachment of the clamping element to the fastening region on the barrel element side can for example be achieved by implementing the fastening region on the barrel element side by a threaded section, especially formed in the region of the free end protruding into the hollow cylindrical section of the silencer element, especially an externally threaded section, or at least implementing the fastening region to comprise such a threaded section, and the clamping element is implemented at least partly with a mating threaded section corresponding to the threaded section forming the fastening region on the barrel element side or at least to comprise such a threaded section. Therefore, the clamping element can be or is screwed to the threaded section on the barrel element side by means of the mating threaded section forming a corresponding mating fastening region, or vice-versa. In particular, this enables the releasable fastening of the clamping element onto the fastening region on the barrel element side.

The shape-locking attachment of the clamping element to the fastening region on the barrel element side can for example be carried out by implementing the fastening region on the barrel element side as a latching section, especially in the region of the free end protruding into the hollow cylindrical section of the silencer element, or at least to comprise such a latching section, and implementing the clamping element at least partly with or at least comprising a mating latching section corresponding to the latching section forming the fastening region on the barrel element side. Therefore, the clamping element is or can be latched to the latching section on the barrel element side by means of a mating latching section forming a corresponding mating fastening region, or vice-versa. This enables both releasable and non-releasable (without damage or destruction) fastening of the clamping element onto the fastening region on the barrel element side. Suitable latching sections and mating latching sections can be formed by geometric design, for example by, possibly undercut, protrusion-like journals and journal receiving elements corresponding thereto.

A possibly additional bonded fastening of the clamping element to the fastening region on the barrel element side can for example be carried out by gluing the clamping element to the fastening region on the barrel element side, or vice-versa. This especially enables the irreversible fastening of the clamping element onto the fastening region on the barrel element side.

Concerning the geometric structural design of the clamping element, the clamping element can be implemented in an annular form. In particular, a base body of the clamping element can be implemented in an annular form. Regarding the aforementioned types of fastening for fastening a corresponding clamping element to a corresponding fastening region on the barrel element side, an annular clamping element or a clamping element with an annular base body on the inner peripheral side can be implemented at least partly with a mating threaded section corresponding to the threaded section forming the fastening region on the barrel element side or at least can be implemented to comprise such a base body and/or can be implemented on the internal peripheral side at least partly with an adhesive region covering the fastening region on the barrel element side or at least to comprise such an adhesive region.

The at least one contact element on the silencer element side can be formed by an end face of at least one web element facing away from the contact element on the barrel element side and thereby facing towards an opening on the silencer element side or gun side. A corresponding web element extends axially at least partly along a hollow cylindrical base body, which is especially made of a metal, on the silencer element side and bounds a barrel element accommodating region on the silencer element side. The silencer element can therefore comprise a design consisting of a hollow cylindrical base body and at least one web element extending in the axial direction along the base body. Typically, the silencer element comprises a plurality of corresponding web elements, each of which extends in the axial direction along the base body.

Of course, it is also possible to fasten a clamping element to a corresponding contact element on the silencer element side, i.e. to the end face of at least one corresponding web element. The clamping element can therefore also be or is attached to the silencer element in a shape-locking and/or force-locking and/or bonded manner. In connection with the mentioned annular design of the clamping element, it is for example possible that the base body of the clamping element is implemented with or at least comprises an adhesive region at least partly in the region of an end face facing towards an end face of a web element on the silencer element side. Alternatively or additionally, a corresponding web element can be implemented with or can at least comprise an adhesive region on an end face.

A web element typically extending axially along the inner periphery of the base body is especially used to accurately bound a barrel element accommodating region from a functional viewpoint, especially axially, radially and peripherally. A barrel element accommodating region essentially means a hollow cylindrical region within the silencer element, in which a barrel element can be at least partly accommodated. The dimensions of the barrel element accommodating region, i.e. especially the internal diameter, are typically adapted to the dimensions, i.e. especially the external diameter, of the barrel element that is accommodated therein. The barrel element accommodating region thus enables accurate fitting and thereby stable accommodation of a corresponding barrel element within the silencer element. In addition, the barrel element accommodating region typically enables accurate orientation or positioning of the barrel element relative to the silencer element and thereby accurate centering of the barrel element within the silencer element. The accommodation of the barrel element is carried out typically by axially inserting the barrel element into the silencer element or by axially pushing the silencer element onto the barrel element.

Typically, a plurality of corresponding web elements are provided. In this case, the web elements are disposed or formed spaced apart peripherally around the inner periphery of the base body on the silencer element side. Respective web elements are typically disposed or formed symmetrically relative to the central axis of the base body on the silencer element side. In this case, a respective expansion channel of the silencer element is formed by respective spaces formed between two adjacently disposed web elements. From the functional viewpoint, because of the formation of corresponding expansion channels, the web elements can also be used for reducing firing-induced noise emissions by the formation of corresponding expansion channels.

Regarding the further design of the silencer element, the or a hollow cylindrical base body on the silencer element side can be covered by a covering element, especially of a plastic material, such as for example PA, PC, PP etc., at least partly, especially fully on the outer periphery, and at least partly on the inner periphery. In this case, respective web elements typically form part of the covering element.

The covering element is typically implemented as a one-piece or integral body, especially made in an injection molding process. Accordingly, the forming or shaping of the covering element on the base body on the silencer element side is carried out preferably in an injection molding process or procedure, in which the base body on the silencer element side is encapsulated by an injection molding material, especially a synthetic injection molding material. Advantageously, the base body on the silencer element side can be provided with at least one, especially axial, slot-shaped through opening, which is passed through during the molding or injection molding by the material forming the covering element, whereby a (mechanically) stable joint is formed between the covering element and the base body. The formation of corresponding web elements is easily possible during an injection molding process by using suitable injection molding provisions, i.e. especially injection molding mold slides.

Overall, injection molding processes enable the implementation of suitable silencer elements with complex shapes or geometries. Equally, using injection molding processes that are simple in terms of production technology and thereby efficient, different surface structures can be implemented in a silencer element, also including especially an anti-slip surface ("fish skin") and legends, logos, etc.

It should be noted that according to the invention, no molding of the silencer element on a barrel element by means of an injection molding process and thereby no molding of the silencer element on a barrel element is carried out. Only the silencer element can be formed in an injection molding process.

It has already been mentioned that the silencer element can be or is fastened rotationally securely onto or relative to the barrel element. The rotationally secure fastening of the silencer element onto the barrel element or relative to the barrel element can, as mentioned, on the one hand result from the axial clamping of the silencer element against the contact element on the barrel element side. Alternatively or additionally, however, separate structural measures can be taken that enable the rotationally secure fastening of the silencer element onto the barrel element or relative to the barrel element.

A structural measure for implementing the rotationally secure fastening of the silencer element onto the barrel element or relative to the barrel element can for example be implemented by disposing or forming at least one first anti-rotation element on a covering element, especially in the region of its end facing towards the contact element on the barrel element side and thereby facing away from an opening on the silencer element side or on the gun side, and disposing or forming at least one second anti-rotation element corresponding to the first anti-rotation element on the contact element on the barrel element side, especially in the region of its opening facing towards the covering element and thereby facing towards an opening on the silencer element side or the gun side. A corresponding first anti-rotation element is implemented to work together with a corresponding second anti-rotation element to form an anti-rotation fastening of the silencer element preventing peripheral rotation of the silencer element relative to the barrel element, and vice-versa.

A first anti-rotation element on the silencer element side can be implemented as or can comprise a protrusion-like journal, for example, a second anti-rotation element on the barrel element side can accordingly be implemented as or can comprise a corresponding journal receiving element.

Conversely, it is also possible that an anti-rotation element on the barrel element side is implemented as or comprises a protrusion-like journal and a first anti-rotation element on the silencer element side is implemented as or comprises a corresponding journal receiving element. Of course, it is also possible that anti-rotation elements are implemented in the form of protrusion-like journals and corresponding journal receiving elements both on the silencer element side and on the contact element side.

In principle, respective anti-rotation elements on the silencer element side and on the contact element side can be implemented in any form from the geometric design viewpoint as long as they can work together to form a suitable rotationally secure fastening of the silencer element onto or relative to the barrel element. For example, respective anti-rotation elements on the silencer element side and on the contact element side can also comprise variable cross-sections, for example with an axially and/or peripherally conical shape. Depending on the specific geometric structural design, for example the cross-sections of respective anti-rotation elements, the interworking of respective anti-rotation elements on the silencer element side and on the contact element side can enable the implementation of a (non-damaging and non-destructive) reversible or irreversible shape-locking connection of the respective anti-rotation elements on the silencer element side and on the contact element side. In this connection, a shape-locking connection also means a (non-damaging and non-destructive) reversible or irreversible snap-fit connection; therefore, it is also conceivable that the silencer element is latched onto the contact element on the barrel element side or vice-versa.

Returning to the embodiment of the clamping element with an annular base body, it is conceivable that at least one through channel passing axially through the base body is formed in the annular base body. The clamping element can thus be an air regulating ring associated with the silencer element. In addition to the task or function of the axial clamping of the silencer element against the contact element on the barrel element side, as a corresponding air regulating ring the clamping element can therefore also perform a further task or function in connection with the reduction of firing-induced noise emissions.

At least one, especially tubular, silencing element can be disposed or formed in the hollow cylindrical section of the silencer element mentioned above in connection with the fastening of the clamping element onto the fastening region on the barrel element side. Suitable silencing elements constitute significant functional elements for reducing firing-induced noise emissions of the silencer element.

If a plurality of silencing elements are provided, said elements can be disposed in the hollow cylindrical section of the silencer element in an axially successive arrangement. In particular, it is possible to clamp said silencing elements axially against each other by means of a spring element that is also disposed in the hollow cylindrical section. The silencing elements can especially be clamped between the clamping element and an especially hollow cylindrical or tubular closure cap element that is fastened in the region of the opening of the silencer element. The axial clamping of the silencing elements enables a stable arrangement of the silencing elements within the hollow cylindrical section of the silencer element.

More generally, it is advantageous if an especially tubular and thereby hollow cylindrical closure cap element is provided in the region of the opening of the silencer element that can be or is fastened in a shape-locking and/or force-locking and/or bonded manner. The suitably fastened closure cap element prevents access into the silencer element on the opening side and makes manipulation or dismantling of the silencer element and thereby the gun impossible or makes it significantly difficult. In addition to screwing in a closure cap element provided with a threaded section into an end of the silencer element on the opening side, which can be provided with a corresponding mating threaded section for this, for example gluing the closure cap element into the end of the silencer element on the opening side is advantageous for fastening the closure cap element to the silencer element, as gluing enables fastening of the closure cap element to the silencer element that is non-releasable or only releasable with difficulty.

The invention further concerns a method for manufacturing a gun as described. The method is especially characterized by the following steps:

- forming and/or providing a barrel element forming at least part of a barrel of the gun with at least one contact element on the barrel element side that is disposed or formed on the barrel element,
- forming and/or providing a silencer element to be fastened onto the barrel element,
- fastening the silencer element onto the barrel element to form a barrel arrangement, wherein for fastening to the barrel element the silencer element is clamped against the at least one contact element that is disposed or formed on the barrel element by means of at least one clamping element that is or can be fastened axially within the silencer element, and
- attaching the barrel arrangement to a base body of the gun to form the gun.

In principle, the same descriptions that apply in connection with the gun apply analogously to the method. Conversely, all descriptions in connection with the method apply analogously to the gun.

The silencer element can be formed by molding, especially injection molding, a covering element onto a hollow cylindrical base body of the subsequent silencer element, wherein the covering element is molded onto the hollow cylindrical base body, especially injection molded, such that it covers the base body at least partly, especially fully, on the outside and at least partly on the inside. The molding is advantageously implemented by an injection molding process. The covering element is correspondingly advantageously formed from an injection molding material, especially a synthetic injection molding material, such as for example PA, PC, PP etc. Advantageously, the base body is provided on the silencer element side with at least one, especially axial, slot-like through opening, which is passed through by the material forming the covering element during the molding or injection molding, whereby a (mechanically) stable joint is formed between the covering element and the base body.

In addition, in connection with the method it should be mentioned that according to the invention no molding of the silencer element onto a barrel element by means of an injection molding process is carried out and thus no injection molding of the silencer element onto a barrel element is carried out. Only the silencer element can be implemented in an injection molding process.

When molding or injection molding the covering element onto the base body on the silencer element side, at least one web element extending at least partly along the hollow cylindrical base body and bounding a barrel element accommodating region on the silencer element side for accommodating and/or positioning the barrel element within the silencer element can be formed. The formation of corresponding web elements is easily possible during an injection molding process by using suitable injection molding measures, i.e. especially injection molding mold slides.

Following the formation of the barrel arrangement, at least one silencing element can be disposed in a hollow cylindrical section of the silencer element and possibly clamped by means of at least one spring element. Then the opening of the silencer element can be closed by means of a closure cap element and the silencing elements may be axially clamped between the clamping element and the closure cap element. The closure cap element is typically fastened in a shape-locking and/or force-locking and/or bonded manner in the region of the opening of the silencer element.

Figure 2:
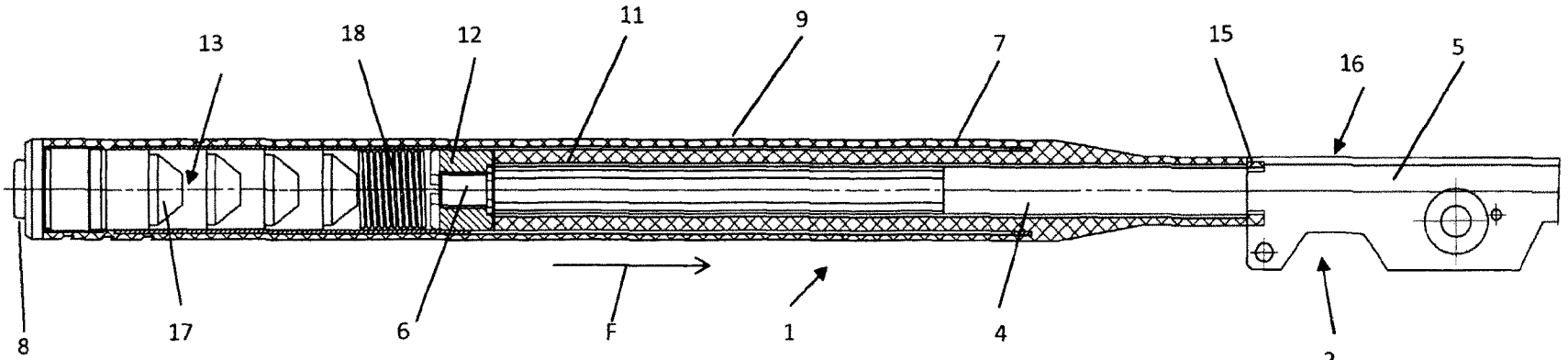
Figure 3:
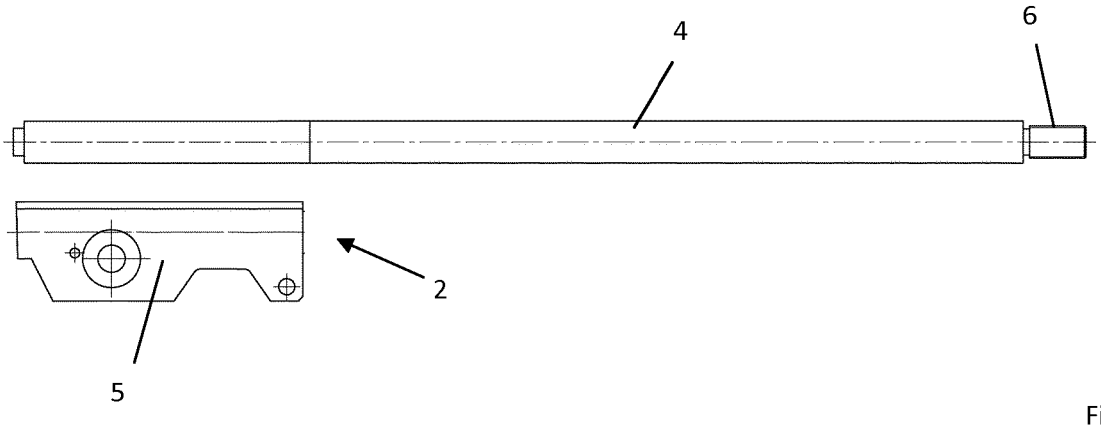
Figure 4:
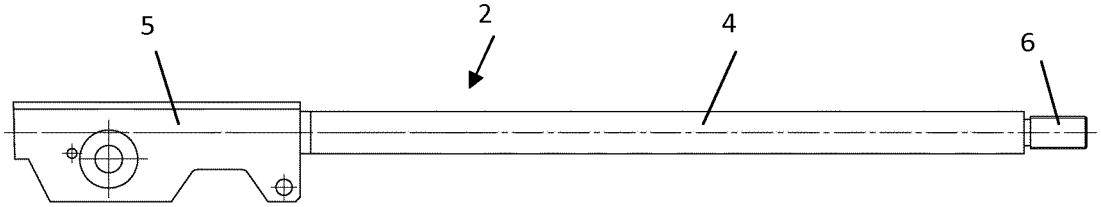
Figure 5:
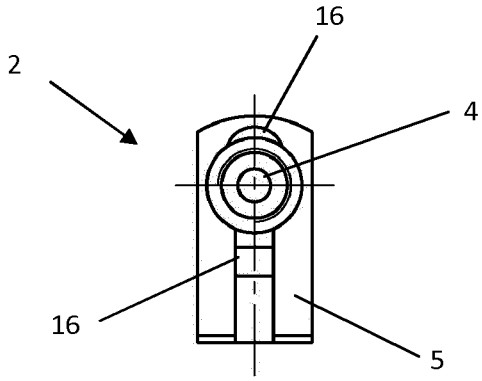
Figure 6:
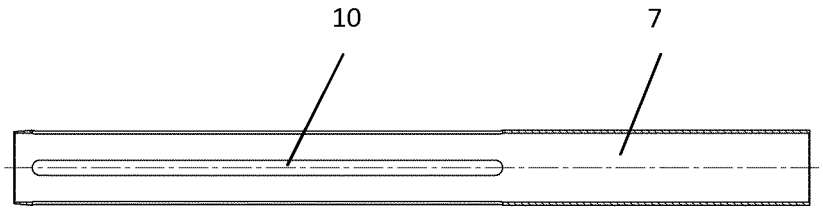
Figure 7:
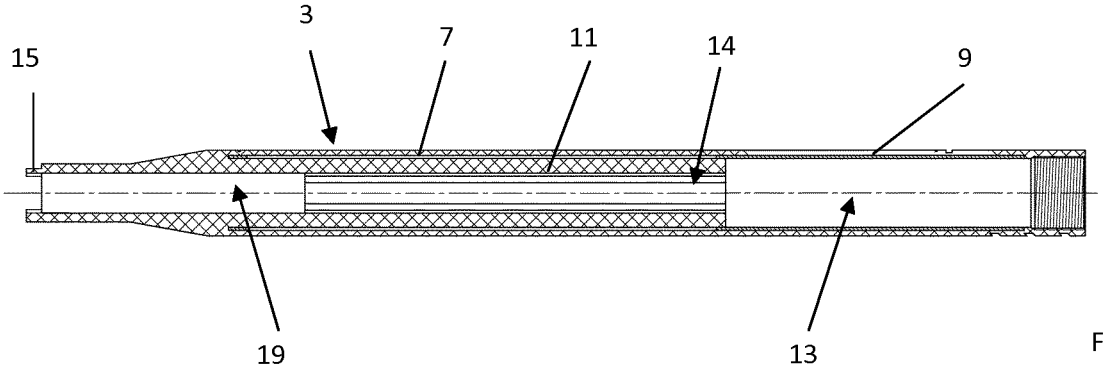
Figure 8:
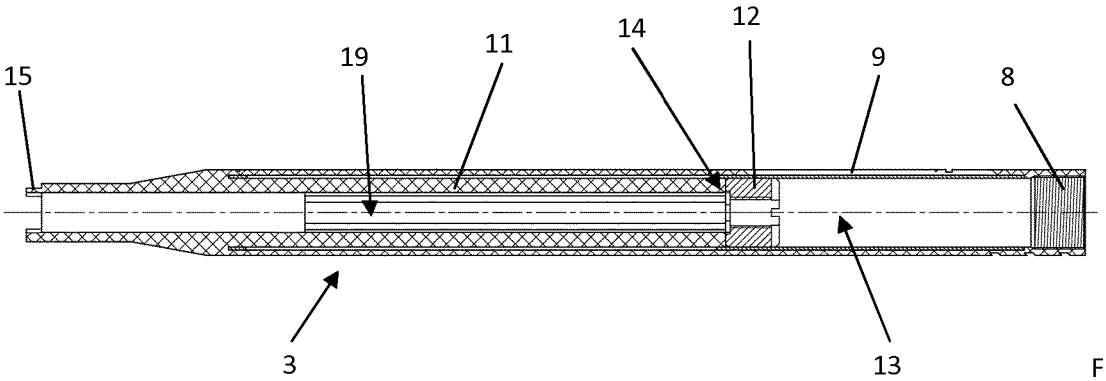

The invention is explained in detail using exemplary embodiments in the figures. In the figures:

FIGS. 1, 2 each show a basic representation of a barrel arrangement of a gun according to an exemplary embodiment of the invention;

FIGS. 3-5 each show a basic representation of a barrel element of a gun according to an exemplary embodiment of the invention; and FIGS. 6-8 each show a basic representation of a silencer element of a gun according to an exemplary embodiment of the invention.

FIGS. 1, 2 each show a basic representation of a barrel arrangement 1 of a gun that is not shown in detail according to an exemplary embodiment of the invention. It can be seen that FIG. 1 is an exploded view of the barrel arrangement 1 and FIG. 2 is a longitudinal sectional view of the barrel arrangement 1.

The barrel arrangement 1 comprises a barrel element 2 forming the barrel of the gun and a silencer element 3 that can be fixed or is fixed to the barrel element 2 for reducing firing-induced noise emissions.

As can be seen from the respective schematic representations of the barrel element 2 and the components associated therewith in FIGS. 3-5, wherein FIG. 3 shows an exploded view of the barrel element 2, FIG. 4 shows an installation view of the barrel element 2 and FIG. 5 shows a front view of the barrel element 2 on the opening side, the barrel element 2 comprises a hollow cylindrical elongated section 4 forming the actual barrel of the gun and a contact element 5 on the barrel element side. Of course, the contact element is provided on the barrel element side 5 with a cylindrical bore that is coaxial with a barrel bore of the elongated section 4.

A fastening region 6 implemented as a threaded section on the barrel element side is disposed or formed on the elongated section 4 in the region of a free end, and the contact element 5 on the barrel element side is disposed or formed in the region of a free end lying opposite said fastening region 6. The contact element 5 on the barrel element side is captively joined to the elongated section 4, which for example, if the contact element 5 on the barrel element side and the elongated section 4 are implemented as separate components, can be implemented by means of a shape-locking and/or force-locking and/or bonded fastening, such as for example a press fit, or by a one-piece or integral formation of the elongated section 4 with the contact element 5 on the barrel element side.

It can be seen that the contact element 5 on the barrel element side comprises bores that are not indicated in detail and that, in the properly mounted state of the gun, are passed through by a swivel bolt, by means of which attachment of the barrel arrangement 1 to a base body of the gun is also typically carried out. The barrel arrangement 1 is pivotably mounted relative to the base body of the gun by means of the swivel bolt. Accordingly, the gun comprises a break barrel. The principle described below is, however, also suitable for guns with a non-pivotable barrel arrangement 1, i.e. for guns with a rigid barrel.

As shown in the respective schematic representations of the silencer element 3 and the components associated therewith in FIGS. 6-8, wherein FIG. 6 shows a detailed view of a base body 7 of the silencer element 3 and each of FIGS. 7, 8 shows a longitudinal sectional view through the silencer element 3 with a closure cap element 8 (FIG. 8) fastened in the region of the opening of the silencer element 3, for example in a bonded manner by gluing, and without a closure cap element 8 (FIG. 7) fastened in the region of the opening of the silencer element 3, the silencer element 3 comprises a hollow cylindrical base body 7 that is covered by a covering element 9 that is molded onto said base body. The base body 7 is made of a metal, for example a steel that may be oxidized, and the covering element 9 is made of a synthetic injection molding material, such as for example PA.

The molding of the covering element 9 onto the base body 7 is carried out by means of an injection molding process, in which the base body 7 is injection molded with the injection molding plastic material forming the covering element 9. During the injection molding process, the injection molding plastic material forming the covering element 9 passes through the axially extending elongated or slot-like perforations 10 formed in the base body 7, whereby a (mechanically) stable joint is formed between the covering element 9 and the base body 7.

As can be seen, the covering element 9 when viewed axially extends fully over the outer periphery of the base body 7 or protrudes beyond the base body 7 on both sides. Web elements 11, which extend axially along the inner periphery of the base body 7, are formed in the region of the inner periphery of the base body 7 in one piece with the covering element 9, but said web elements do not protrude axially, at least in the region of the free end thereof on the opening side. The web elements 11 are peripherally spaced about the inner periphery of the base body 7 and are disposed or formed symmetrically relative to the central axis of the base body 7.

The web elements 11 bound a barrel element accommodating region 19 on the silencer element side and are used from the functional viewpoint to accommodate the barrel element 2 in the silencer element 3. An expansion channel of the silencer element 3 is formed in each case by respective spaces formed between two juxtaposed web elements 11, so that from the functional viewpoint the web elements 11 are also used for the reduction of firing-induced noise emissions by the formation of corresponding expansion channels.

The fastening of the silencer element 3 onto the barrel element 2 is carried out by axially clamping the silencer element 3 against the contact element 5 on the barrel element side. By the axial clamping of the silencer element 3 against the contact element 5 on the barrel element side, the silencer element 3 is in principle captively and irreversibly disposed, i.e. typically also secured in location or position. Depending on the clamping force indicated in FIG. 2 by the arrow F, the rotationally secure fastening of the silencer element 3 onto or relative to the barrel element 2 may also result from the axial clamping of the silencer element 3 against the contact element 5 on the barrel element side. The rotationally secure fastening of the silencer element 3 onto or relative to the barrel element 5 is, however, achieved in any case by means of structural measures that are yet to be described below.

The axial clamping of the silencer element 3 against the contact element 5 on the barrel element side is carried out by means of a clamping element 12. Using the clamping element 12, an axial force (clamping force) can be exerted on the silencer element 3, by means of which the silencer element 3 is clamped axially against the contact element 5 on the barrel element side. The clamping of the silencer element 3 against the contact element 5 on the barrel element side, and thereby the fastening of the silencer element 3 onto the barrel element 2, is carried out by fastening the clamping element 12 onto the barrel element 2, i.e. to the fastening region 6 on the barrel element side. Releasing the clamping of the silencer element 3 against the contact element 5 on the barrel element side is also possible by releasing the fastening of the clamping element 12 onto the fastening region 6 on the barrel element side.

The described arrangement or fastening of the clamping element 12 is carried out by fastening the clamping element 12 onto the fastening region 6 on the barrel element side protruding into the hollow cylindrical section 13 of the silencer element 3. In this case, the clamping element 12 is axially clamped against a contact element 14 on the silencer element side such that the silencer element 3 is clamped against the contact element 5 on the barrel element side. The contact element 14 on the silencer element side is the exposed end faces of the respective web elements 11.

The "internal fastening" of the clamping element 12 is carried out, as mentioned, by means of the fastening region 4 on the barrel element side, which protrudes into the hollow cylindrical section 13 of the silencer element 3. The clamping element 12 comprises a mating fastening region corresponding to the fastening region 6 on the barrel element side. In principle, the clamping element 12 can be fastened to the fastening region 6 on the barrel element side in a shape-locking and/or force-locking and/or bonded manner.

In the exemplary embodiments shown in the fig., the clamping element 12 is fastened in a force-locking manner to the fastening region 6 on the barrel element side. The force-locking fastening of the clamping element 12 to the fastening region 6 on the barrel element side is carried out by implementing the fastening region 6 on the barrel element side as a threaded section in the form of an external thread and implementing the clamping element 12 with a mating threaded section corresponding to the threaded section forming the fastening region 6 on the barrel element side. Therefore, the clamping element 12 can be or is screwed to the threaded section on the barrel element side by means of the mating threaded section forming a corresponding mating fastening region, or vice-versa. This enables the reversible fastening of the clamping element 12 onto the fastening region 6 on the barrel element side.

A possibly additional bonded fastening of the clamping element 12 to the fastening region 6 on the barrel element side can be carried out by gluing the clamping element 12 to the fastening region 6 on the barrel element side, or vice-versa. This enables the irreversible attachment of the clamping element 12 to the fastening region 6 on the barrel element side.

As can especially be seen from FIG. 2, the clamping element 12 is disposed or fastened within the silencer element 3, i.e. within the hollow cylindrical section 13 of the silencer element 3 in front of the opening of the barrel element 2, so that is not accessible from the outside or only accessible with difficulty. Equally, the clamping element 12 is not visible from the outside, so that the principle of fastening of the silencer element 3 onto the barrel element 2 cannot be detected without suitable knowledge. The manipulation or dismantling of the silencer element 3 is not possible or is only possible with difficulty, at least without special tools.

The clamping element 12 comprises an annular base body and is therefore implemented in an annular form. Regarding the type of fastening of the clamping element 12 to the fastening region 6 on the barrel element side described above, the clamping element 12 is formed on the inside with a mating threaded section corresponding to the threaded section forming the fastening region 6 on the barrel element side. It would also be conceivable that the clamping element 12 is formed on the inside with an adhesive region covering the fastening region 6 on the barrel element side.

A plurality of said through channels (not shown), each axially passing through the annular base body, are formed in the annular base body of the clamping element 12. The clamping element 12 is thus an air regulating ring associated with the silencer element 3. The clamping element 12 therefore carries out a further task or function as a corresponding air regulating ring in connection with the reduction of firing-induced noise emissions in addition to the task or function of axially clamping the silencer element 3 against the contact element 5 on the barrel element side.

It has been mentioned that the silencer element 3 is fastened rotationally securely onto or relative to the barrel element 2. The rotationally secure fastening of the silencer element 3 onto the barrel element 2 or relative to the barrel element 2 can, as mentioned, result on the one hand just from the axial clamping of the silencer element 3 against the contact element 5 on the barrel element side. A separate structural measure is described below that enables the rotationally secure fastening of the silencer element 3 onto the barrel element 2 or relative to the barrel element 2 independently of the axial clamping of the silencer element 3 against the contact element 5 on the barrel element side.

As can be seen especially using FIGS. 1, 2, 7, 8, a plurality of first anti-rotation elements 15 are formed on the covering element 9 in the region of the end facing towards the contact element 5 on the barrel element side, and thereby facing away from the opening on the silencer element side or on the gun side. As can be seen using FIGS. 2 and 5, a plurality of second anti-rotation elements 16 corresponding to the first anti-rotation elements 15 are formed on the contact element 5 on the barrel element side in the region of the end facing towards the covering element 9, and thereby facing towards the opening on the silencer element side or on the gun side. Respective first anti-rotation elements 15 are implemented to work together with respective second anti-rotation elements 16 to form a rotationally secure fastening of the silencer element 3 preventing a peripheral rotation of the silencer element 3 relative to the barrel element 2, and vice-versa. Respective first anti-rotation elements 15 on the silencer element side are implemented as protrusion-like journals in the exemplary embodiments shown in the fig. Respective second anti-rotation elements 16 on the barrel element side are implemented as corresponding journal receiving elements.

Using FIGS. 1, 2, it can be seen that a plurality of tubular silencing elements 17 are disposed in the hollow cylindrical section 13 of the silencer element 3. The silencing elements 17 constitute significant functional elements for reducing firing-induced noise emissions of the silencer element 3.

The silencing elements 17 are disposed in the hollow cylindrical section 13 of the silencer element 3 in an axially successive arrangement and are axially clamped against each other by a spring element 18 that is also disposed in the hollow cylindrical section 13 between the clamping element 12 and the closure cap element 8 fastened in the region of the opening of the silencer element 3. The axial clamping of the silencing elements 17 enables a stable arrangement of the silencing elements 17 within the hollow cylindrical section 13 of the silencer element 3.

A method for manufacturing a gun as described comprises the following steps:

- forming and/or providing a barrel element 2 forming at least part of a barrel of the gun with at least one contact element 5 on the barrel element side that is disposed or formed on the barrel element 2,
- forming and/or providing a silencer element 3 for fastening onto the barrel element 2,
- fastening the silencer element 3 onto the barrel element 2 to form a barrel arrangement 1, wherein for fastening onto the barrel element 2 the silencer element 3 is clamped axially against the at least one contact element 5 that is disposed or formed on the barrel element 2 by means of at least one clamping element 12 that is or can be fastened within the silencer element 3, and
- attaching the barrel arrangement 1 to a base body of the gun, thus forming the gun.

The silencer element 3 is formed by molding or injection molding of a covering element 9 onto a hollow cylindrical base body 7 of the subsequent silencer element 3, wherein the covering element 9 is molded or injection molded onto the hollow cylindrical base body 7 such that it covers said base body at least partly, especially fully, on the outside, and at least partly on the inside. The covering element 9 is made of an injection molding material, especially a synthetic injection molding material, such as for example PA, PC, PP etc. The base body 7 is provided with at least one slot-like through opening 10 on the silencer element side, which is passed through by the material forming the covering element 9 during the molding or injection molding, whereby a (mechanically) stable joint is formed between the covering element 9 and the hollow cylindrical base body 7.

No molding of a silencer element 3 onto a barrel element 2 by means of an injection molding process, and thereby no injection molding of a silencer element 3 onto a barrel element 3, is carried out within the scope of the method. Only the silencer element 3 is implemented in an injection molding process. The barrel element 2 that is to be considered as a separate component or a separate group of components is axially in the silencer element 3 that is likewise to be considered as a separate component or a separate group of components or by axially pushing the silencer element 3 onto the barrel element 2.

During the molding or injection molding of the covering element 9 onto the base body 7 on the silencer element side, a barrel element accommodating region 19 is formed on the silencer element side for accommodation and/or positioning of the barrel element 2 within the web elements 11 extending axially along the hollow cylindrical base body 7 and bounding the silencer element 3. The formation of corresponding web elements 11 is easily possible during an injection molding process by suitable injection molding measures, i.e. especially injection molding mold slides.

Following the formation of the barrel arrangement 1, a spring element 18 and corresponding silencing elements 17 are disposed in the hollow cylindrical section 13 of the silencer element 3. Then the opening of the silencer element 3 is closed by means of a closure cap element 8. The closure cap element 8 is fastened in the region of the opening of the silencer element 3 in a shape-locking and/or force-locking and/or bonded manner for this purpose. The silencing elements 17 are axially clamped by means of the spring elements 18 between the clamping element 12 and the closure cap element 8 and are thereby disposed in a stable manner.

The gun described with reference to the exemplary embodiments shown in the figures comprises a barrel arrangement 1 with a two-stage silencer element 3, which combines the functions of an integrated air regulating ring with corresponding silencing elements 17 in a synergetic manner, so that firing-induced noise emissions are particularly effectively reduced.

REFERENCE CHARACTER LIST

1 barrel arrangement
2 barrel element
3 silencer element
4 section
5 contact element
6 fastening region
7 base body
8 closure cap element
9 covering element
10 perforations
11 web element
12 clamping element
13 section
14 contact element
15 anti-rotation element
16 anti-rotation element
17 silencer element
18 spring element
19 barrel element accommodating region

The invention claimed is:

1. A gun, comprising:

a barrel arrangement (1) comprising:

a barrel element (2) forming at least part of a barrel of the gun, the barrel element (2) having a distal portion and a proximal portion; and a silencer element (3) having a distal portion and a proximal portion;

a contact element (5) having a distal portion and a proximal portion;

wherein the silencer element (3) is axially clamped, by a clamping element (12) fastened within the silencer element (3) at the distal portion of the barrel element (2), and coupled onto and against the contact element (5) coupled to the proximal portion of the barrel element (2), the distal portion of the contact element (5) being disposed or formed substantially at the proximal portion of the barrel element (2).

2. The gun as claimed in claim 1, wherein the clamping element (12) is clamped axially against at least one contact element (14) on the silencer element side such that the silencer element (3) is clamped against the contact element (5) on the barrel element side.

3. The gun as claimed in claim 1, characterized in that the at least one contact element (14) on the silencer element side is formed by a web element (11) bounding an end face of at least one barrel element accommodating region (19) on the silencer element side facing away from the contact element (5) on the barrel element side and extending axially at least partly along a hollow cylindrical base body (7) on the silencer element side.

4. The gun as claimed in claim 3, characterized in that a plurality of corresponding web elements (11) are disposed or formed peripherally spaced around the inner periphery of the base body (7) on the silencer element side, wherein an expansion channel of the silencer element (3) is formed by a gap that is formed between two juxtaposed web elements (11).

5. The gun as claimed in claim 1, characterized in that a hollow cylindrical base body (7) on the silencer element side is covered at least partly on the outside, and at least partly on the inside by a covering element (9) that is made of a synthetic material, wherein at least one web element of the plurality of corresponding web elements (11) bounding at least one region (19) of the barrel element (2) on the silencer element side and extending axially at least partly along the hollow cylindrical base body (7) on the silencer element side forms part of the covering element (9).

6. The gun as claimed in claim 1, characterized in that the silencer element (3) can be or is fastened rotationally securely onto the barrel element (2).

7. The gun as claimed in claim 1, characterized in that at least one first anti-rotation element (15) is disposed or formed on a covering element (9), in the region of the end thereof facing towards the contact element (5) on the barrel element side, and at least one second anti-rotation element (16) corresponding to the first anti-rotation element (15) is disposed or formed on the contact element (5) on the barrel element side, in the region of the end thereof facing towards the covering element (9), wherein the at least one first anti-rotation element (15) is implemented to work together with the at least one second anti-rotation element (16) to form a rotationally secure fastening of the silencer element (3) preventing a peripheral rotation of the silencer element (3) relative to the barrel element (2), and vice-versa.

8. The gun according to claim 1, characterized in that the clamping element (12) can be or is fastened to a fastening region (6) on the barrel element side in a shape-locking and/or force-locking and/or bonded manner.

9. The gun as claimed in claim 8, characterized in that the clamping element (12) can be or is fastened to a fastening region (6) on the barrel element side in a force-locking manner, wherein the fastening region (6) on the barrel element side is formed by or at least comprises a threaded section, an externally threaded section, in the region of free end protruding into a hollow cylindrical section (13) of the silencer element (3), and the clamping element (12) is at least partly formed with or at least comprises a mating threaded section corresponding to the threaded section forming the fastening region (6) on the barrel element side, and the clamping element (12) is screwed onto the threaded section on the barrel element side by means of the mating threaded section, or vice-versa, or the clamping element (12) can be or is fastened to the fastening region (6) on the barrel element side in a shape-locking manner, wherein the fastening region (6) on the barrel element side is formed by or at least comprises a latching section that is formed in the region of a free end protruding into the hollow cylindrical section (13) of the silencer element (3), and the clamping element (12) is at least partly formed with or at least comprises a mating latching section corresponding to the latching section forming the fastening region (6) on the barrel element side, and the clamping element (12) is latched with the latching section on the barrel element side by means of the mating latching section, or vice-versa.

10. The gun as claimed in claim 1, characterized in that the clamping element (12) can be or is fastened onto a fastening region (6) on the barrel element side in a bonded manner, wherein the clamping element (12) is glued to the fastening region (6) on the barrel element side, or vice-versa.

11. The gun as claimed in claim 1, characterized in that the clamping element (12) comprises an annular base body, which is formed on the inside at least partly with or at least comprises a mating threaded section corresponding to the threaded section forming fastening region (6) on the barrel element side, and/or is formed on the inside at least partly with or at least comprises an adhesive region covering the fastening region (6) on the barrel element side.

12. The gun as claimed in claim 11, characterized in that at least one through channel is formed in the annular base body that passes axially through the base body, so that the clamping element (12) forms an air regulating ring.

13. The gun as claimed in claim 1, characterized in that a plurality of axially aligned tubular silencing elements (17) are disposed in a hollow space hollow space between the distal portions of the silencer element (3) and the barrel element (2).

14. The gun as claimed in claim 1, characterized by a tubular closure cap element (8) that can be fastened or is fastened in the region of an opening of the silencer element (3) in a shape-locking and/or force-locking and/or bonded manner.

15. The gun as claimed in claim 1, wherein the at least one clamping element (12) is not externally accessible and/or not externally visible.

16. The gun as claimed in claim 1, wherein an axial force is exerted by the silencer element (3) being clamped axially against the contact element (5) by the at least one clamping element (12).

17. The gun as claimed in claim 1, wherein the silencer element (3) is at least partially arranged flush over the barrel element (2) from the proximal portion of the silencer element (3) to the clamping element (12).

18. The gun as claimed in claim 1, wherein the clamping element (12) is disposed or formed at the distal end of the barrel element (3).

19. A method for manufacturing a gun, characterized by the following steps:

forming and/or providing a barrel element (2) forming at least part of a barrel of the gun, the barrel element (2) having a distal portion and a proximal portion with at least one contact element (5) having a distal portion and a proximal portion with the distal portion of the contact element (5) being disposed or formed on the proximal portion of the barrel element (2), forming and/or providing a silencer element (3) to be fastened onto the barrel element (2), fastening the silencer element (3) onto the barrel element (2), thus forming a barrel arrangement (1), wherein the silencer element (3) is moved onto the barrel element (2) and, for fastening onto the barrel element (2), is clamped axially against the at least one contact element (5) that is coupled to the barrel element (2) by means of at least one clamping element (12) that is or can be fastened within the silencer element (3), and attaching the barrel arrangement (1) to a base body of the gun, thus forming the gun.

* * * * *